United States Patent [19]

Blumenthal et al.

[11] Patent Number: 4,616,776

[45] Date of Patent: Oct. 14, 1986

[54] RECEPTACLE ATTACHED TO A PARKING METER FOR COLLECTION OF MONIES ON A MASS LOCATION BASIS AS DONATIONS FOR CHARITABLE PURPOSES

[76] Inventors: Scott Blumenthal, 6748 Gloria Ave., Van Nuys, Calif. 91432; George Beacon, 15333 Sherman Way; #V335, Van Nuys, Calif. 91405

[21] Appl. No.: 725,542

[22] Filed: Apr. 22, 1985

[51] Int. Cl.[4] ..... E05G 1/00

[52] U.S. Cl. ..... 232/4 R; 232/63; 232/1 D; 232/43.5; 109/52

[58] Field of Search ..... 232/1 D, 4 R, 6, 15, 232/16, 43.3, 43.5, 55, 63; 109/50, 52; 248/551, 552, 553

[56] References Cited

U.S. PATENT DOCUMENTS

| | | | |
|---|---|---|---|
| 616,767 | 12/1898 | Caron | 232/6 |
| 1,464,008 | 8/1923 | Tang | 109/50 |
| 1,699,476 | 1/1929 | Morin | 248/551 |
| 2,010,877 | 8/1935 | Morell | 232/1 D |
| 2,188,419 | 1/1940 | Saviteer | 232/1 D |
| 3,045,400 | 7/1962 | Grose | 109/52 |
| 3,926,366 | 12/1975 | Sciortino | 232/15 |
| 4,216,901 | 8/1980 | Allen | 232/1 D |

*Primary Examiner*—Gene Mancene
*Assistant Examiner*—John G. Weiss
*Attorney, Agent, or Firm*—Thomas I. Rozsa; Kenneth W. Iles

[57] ABSTRACT

The present invention relates to a receptacle for collection of monies on a mass location basis. Though use of the present invention, money can be safely collected on a mass location basis without the necessity of an individual attendant at each collection site.

7 Claims, 3 Drawing Figures

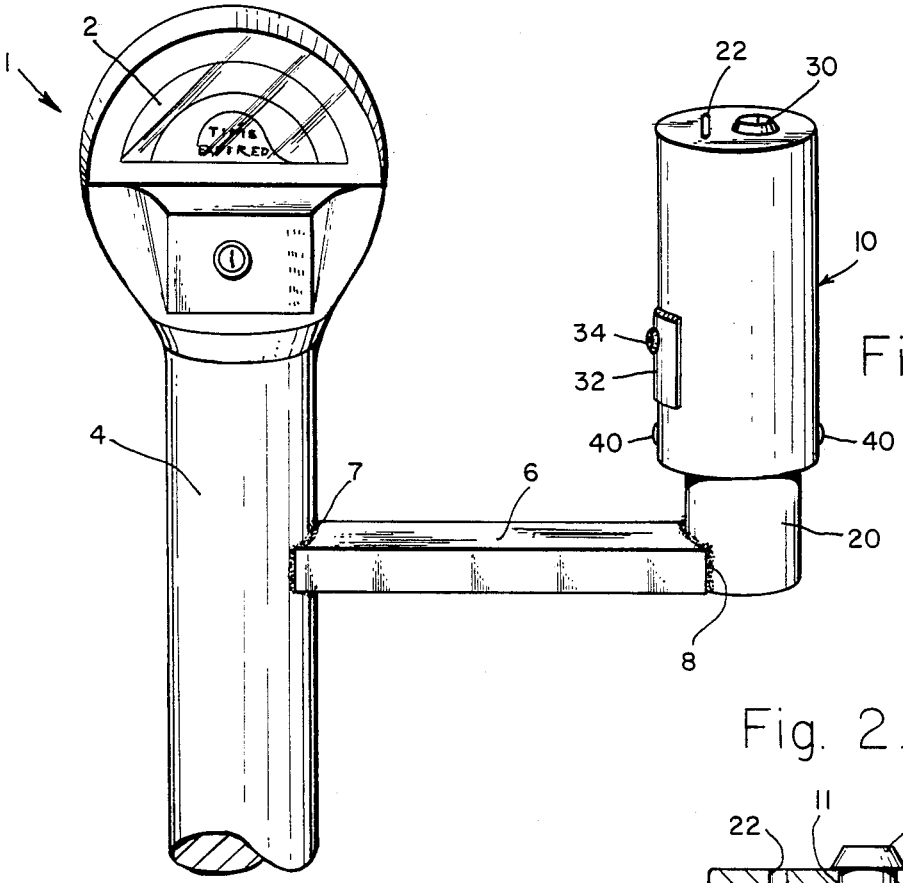
Fig. 1.
Fig. 2.
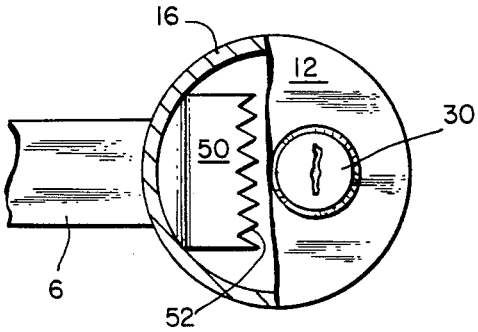
Fig. 3.
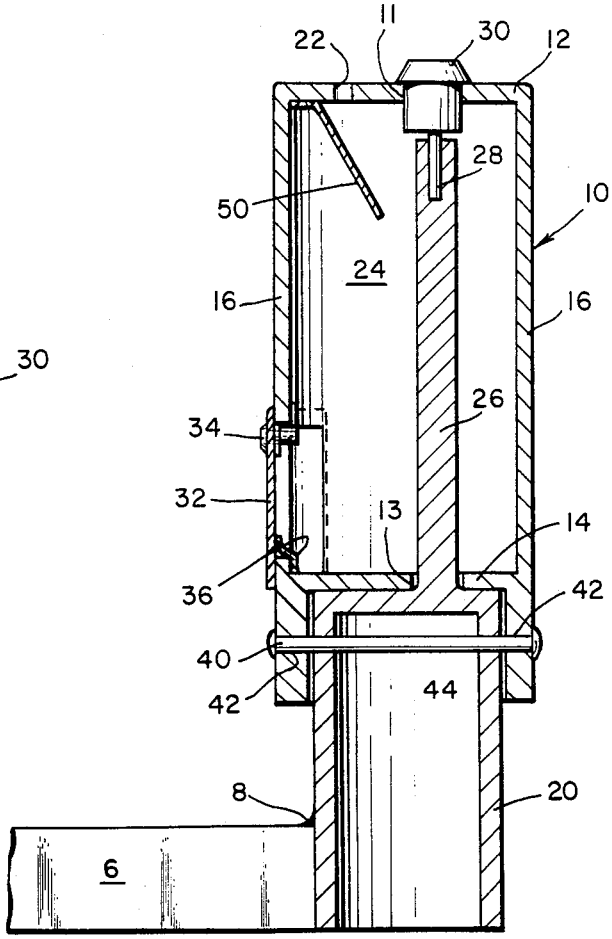

RECEPTACLE ATTACHED TO A PARKING METER FOR COLLECTION OF MONIES ON A MASS LOCATION BASIS AS DONATIONS FOR CHARITABLE PURPOSES

BACKGROUND OF THE INVENTION

1. Field of the Invention

The field of the present invention relates to sealed receptacles which are used for collection of monies in the forms of coins and bills. In its broadest form, the field of the present invention relates to "piggy banks" which are used to collect the monies and from which the monies can be subsequently retrieved through opening the receptacle. More particularly, the present invention focuses on receptacles which can be placed in a mass location format in order to increase the amount of charitable contributions.

2. Description of the Prior Art

In general, receptacles to receive monies are known in the prior art. The most common type of receptacle is the child's "piggy bank". In a more adult form, many conventional safes are provided with a slot where coins or dollar bills can be inserted. The safe is subsequently opened through use of a key to unlock the safe or by setting the appropriate combination in those safes where a combination lock is used.

There is no prior art apparatus which can be used to safely collect monies on a mass location basis without the use an attendant to watch over the collected monies. Collection plates used by organizations such as the salvation army are well known. However, these places have the contributions placed in a plate, bucket or other fully opened receptacle from which the the money can be easily removed. There is no present apparatus which enables an organization to safely collect money through a mass location basis by the use of unattended collection means.

SUMMARY OF THE PRESENT INVENTION

The present invention relates to a receptacle for collection of monies on a mass location basis. Though use of the present invention, money can be safely collected on a mass location basis without the necessity of an individual attendant at each collection site.

It has been discovered, according to the present invention, that if a sealed receptacle is permanently attached to a structure located at numerous locations, such as a parking meter, then duplicate receptacles can be placed at a large multiplicity of individual locations in order to increase the access of the contributing public to such collection receptacles. If the receptacle contains an opening which is sufficiently large to permit coins and bills to be placed into the receptacle but sufficiently small to prohibit the coins and bills from being removed, then the receptacle will function as an effective collection apparatus for the collection of money without the necessity of an attendant being present to guard the collections.

It as also been discovered, according to the present invention, that if the receptacle is fixedly secured to the pole of a parking meter by a transverse beam, then the receptacle will be conveniently located at a mass location structure in order to facilitate easy access to the receptacle by the donating public while at the same time not interfering with the operation of the parking meter itself.

It has additionally been discovered, according to the present invention, that if the receptacle is attaced on a vertical post transversely connected to the connecting beam and the receptacle has a dual lock to facilitate the sealing thereof, then the receptacle can function as a very safe collection means. Additionally, if supplemental securing means such as a transverse rod couples the receptacle to the vertical post, then removal of the receptacle by vandals and thieves becomes extremely difficult and the security of the entire system is substantially enhanced.

It has further been discovered, according to the present invention, that if the receptacle contains a serrated angular plate within its compartment at a location below the opening where the money is deposited, then it is extremely difficult for a thief to insert an object into the receptacle for the purpose of removing any of the money contained therein.

It is therefore an object of the present invention to provide a very safe and secure apparatus for the collection of money at a large multiplicity of locations.

It is a further object of the present invention to provide an apparatus which can be attached to the pole of a parking meter or similar mass location structure in such a fashion that the apparatus or receptacle will not interfere with the normal operation of the parking meter or other structure while at the same time providing a safe and secure collection means for the collection of money.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG. 1 is a front perspective view of the present invention attached to the pole of a parking meter.

FIG. 2 is a vertical longitudinal cross-sectional view of the present invention.

FIG. 3 is a top plan view of the present invention in partial cross-section.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims In general concept, the present invention relate to a receptacle for collection of monies on a mass location basis. Through use of the present invention, money can be safely collected on a mass location basis without the necessity of an individual attendant at each collection site. For purposes of discussion, the apparatus of the present invention will be shown as being attached to the support pole of a parking meter since such a device is located at numerous locations throughout any given area. It will be appreciated that comparable devices which are also located through a given area can be substituted for the pole of the parking meter. Referring to the drawings, the receptacle of the present invention is shown as being generally cylindrical in design. It will be appreicated that other shapes including but not limited to square, rectangular, pentagonal, hexagonal, generally polygonal in cross-section, spherical and hemispherical are also within the spirit and scope of the present invention.

Referring to the drawings and more particularly to FIG. 1, there is shown at 1 the upper portion of a conventional parking meter which includes the timer and money insert portion 2 and the support pole 4 which supports the timer and money insert portion 2 of the parking meter 1. It will be appreciated that the support pole 4 is generally vertically disposed and its lowermost portion (not shown) is firmly secured into the ground, generally by means of concrete. The present invention receptacle for collection of monies 10 is comprised of a sealed and generally hollow receptacle which is offset from the pole 4 by a given distance which by way of example only can be approximately eight inches. The sealed receptacle member 10 is supported by a support column member 20 which is shown as generally vertically disposed in FIG. 1. It is will appreciated that the receptacle 10 and its support member 20 can be aligned in any given direction but the generally vertical direction is the most efficient in terms of support, security, and ease of access by the donating public. The support member 20 is in turn supported by and attached to the pole 4 by a transverse beam 6. The transverse beam is affixed at one end 7 to the pole 4 of the parking meter 1 and is affixed at its other end 8 to the support member 20. Since the parking meter 4 is generally made of metal it is preferred that the transverse beam 6 also be made of metal so that the two can be welded together to assure a first attachment which cannot be removed by thieves and vandals. Similarly, the support member 20 should also be made of metal so that the other end 8 of transverse beam 6 can be welded to the support member 6.

The receptacle 10 comprises a top wall 12, a lower wall 14, and a side wall 16. These walls are best illustrated in FIG. 2. The top wall 12 contains a slotted opening 22 which is large enough to permit coins and bills to be inserted therethrough so that the money can fall into the hollow chamber 24 of the receptacle 10. It will be appreciated that this opening 22 can also be in the side wall 16. As shown in FIG. 2, the receptacle 10 is attached to the support member 20 by being seated onto the support member 20. A column member 26 which is part of the support member 20 extends from the upper portion of the support member 20, extends through an opening 13 in lower wall 14 and extends for most of the length of the receptacle. The upper portion of the column 26 contains a slotted locking member 28. A mating lock member 30 extends through opening 11 in upper wall 12 and downwardly into the chamber 24 until it is connected with the slotted locking member 28 in column 26. This interconnecting means provides a very sure and safe attachment since the locking column 26 is entirely inside the receptacle and therefore is not accessible to vandals and thieves. In one optional method, the collected coins and bills can be retrieved by unlocking the lock member 30 and lifting the entire receptacle off of column 26 and lifting the entire receptacle 10 off of the support member 20. One problem with this method is that the receptacle 10 can be very heavy if many coins are collected and also some coins may fall out of opening 13 once the receptacle has been removed from the column member 26. It is preferred that this locking member 30 remain locked at all times and only be unlocked for purposes of entirely replacing the receptacle 10 with a newer one at such time as the original receptacle has become worn or broken or is replaced for periodic maintenance.

An alternative method for removing the collected coins and bills is by means of a removable wall portion 32 located at the lowermost portion of the chamber 24. The removable wall portion remains closed by means of locking member 34. When such lock is opened, the removable wall portion is moved upwardly and outwardly off shoulder member 36 (which overlaps a portion of wall 16 when the removable wall portion is in the closed postion) so that the removable wall portion 32 can be removed so that the coins and bills can be emptied into a bag (not shown). It is emphasized that this is only one such opening means and other similar opening means to remove collected coins and bills are certainly within the spirit and scope of the present invention.

As shown in FIG. 2, the receptacle 10 is seated onto the support member 20. The lowermost portion of wall 16 extends below lower surface 14 and forms an outer shell member on the uppermost portion of the support member 20. This combined dual wall of the receptacle 10 and support member 20 at the location where they join along with the internal design of the locking column member 26 makes it extremely difficult to remove the receptacle. As an additional security means, a trnasverse rod 40 can be inserted through drilled openings 42 in the walls of the the receptacle 10 and support member 20 respectively. While this will provide a more secure attaching means, it will also mean that the receptacle cannot be removed through unlocking upper locking member 30.

An additional security means for the present invention involves the incorporation of an internal serrated plate member 50 which is best shown in FIGS. 2 and 3. The internal serrated plate 50 is located within the chamber 24 adjacent the slotted opening 22. The serrated plate 50 is set at an angle which by way of example can be approximately 45 degrees to the slotted opening 22. The forward or leading edge of the plate 50 contains serrations 52. Therefore, as coins or bills are inserted into the receptacle 10 through slotted opening 22, they hit the serrated plate 50 and drop into the chamber 50. Should a thief or vandal attempt to remove any of the collected coins or bills by placing an object through the slotted opening 22, the serrated plate will block such inserted object from removing any of the coins or bills.

In its preferred form, the receptacle can also be made of metal comparable to the metal from which the support member 20 and transverse connecting beam 6 are made.

Therefore, through use of the present invention, any multiplicity of receptacles can be located through a given location by attaching a given receptacle to a parking meter or comparable mass location apparatus in the manner described above. In collections for any one of numerous charitable or religious purposes, the present invention provides an apparatus which permits collections to be made at many easily accessible locations. The present invention assures that the collected funds will be retained in a secure manner until an authorized representative of the collecting organization comes to open the receptacle through the manner set forth above.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A receptacle for collection of money comprising:

a. a substantially cylindrical receptacle having a substantially cylindrical side wall, a top wall attached to the top of said side wall, a bottom wall attached to the bottom of said side wall, and a depending skirt portion of said side wall extending below said bottom wall;

b. a slot in said top wall for receiving donations of money into said receptacle;

c. a lockable hinged wall portion in said side wall near said bottom wall for facilitating removal of money from said receptacle;

d. an opening in said top wall;

e. an opening in said bottom wall vertically aligned with said opening in said top wall;

f. a cylindrical support column having a top wall, an integral vertical upstanding locking column member fixedly attached to said top wall of said support column, said support column being attached to an external means for support, the outside diameter of said support column sized to fit within said depending skirt of said receptacle, said top wall of said support column and the adjacent side wall portion of said support column being received within said depending skirt so that said top wall of said support column and said bottom wall of said receptacle are in mutual contact and said locking column member of said support column is inserted through said opening of said bottom wall of said receptacle; and g. means for locking said receptacle to said support column.

2. A receptacle in accordance with claim 1 wherein said locking means further comprises a slot in the top portion of said locking column member and a key-operated lock having a depending male member for mating engagement with said locking column member.

3. A receptacle in accordance with claim 1 wherein said receptacle and said support member are fixedly attached to one another.

4. A receptacle in accordance with claim 3 further comprising a transverse rod fixedly inserted through opposed side wall portions of said depending skirt and said support member to increase the security of said receptacle.

5. A receptacle in accordance with claim 1 wherein said external means for support comprises a standard vertically oriented parking meter.

6. A receptacle in accordance with claim 1 wherein said receptacle and said support member are made of metal.

7. A receptacle in accordance with claim 1 further comprising an elongated locking column member wherein said elongated locking member penetrates said top wall of said receptacle and includes a slot in the portion of said member above said top wall for receiving a means for locking said receptacle and said support member together.

* * * * *